United States Patent [19]

Carlson

[11] Patent Number: 4,856,789

[45] Date of Patent: Aug. 15, 1989

[54] CHESS GAMES

[76] Inventor: Richard A. Carlson, 1514 Ambrose Ave., Cincinnati, Ohio 45224

[21] Appl. No.: 121,689

[22] Filed: Nov. 16, 1987

[51] Int. Cl.[4] ..... A63F 3/02; A63F 3/00

[52] U.S. Cl. ..... 273/261; 273/288

[58] Field of Search ..... 273/260, 261, 262, 288

[56] References Cited

U.S. PATENT DOCUMENTS

| | | | |
|---|---|---|---|
| 3,843,130 | 10/1974 | Whitney | 273/261 |
| 4,021,043 | 5/1977 | Lucero | 273/260 |
| 4,033,586 | 7/1977 | Corinthios | 273/260 |

FOREIGN PATENT DOCUMENTS

| | | | |
|---|---|---|---|
| 2018141 | 10/1979 | United Kingdom | 273/262 |

OTHER PUBLICATIONS

New Chess Game of the Dane, Joseph Boyer, pp. 56–57, 1951.

*Primary Examiner*—Edward M. Coven
*Assistant Examiner*—Benjamin Layno
*Attorney, Agent, or Firm*—Kinney & Schenk

[57] ABSTRACT

An improved chess set, for play by opposing two-man teams, comprises a game board fifteen squares wide and twelve squares deep. Each team has a playing piece set comprising a common king and a player set for each of the team players. Each player set, color coded for identification, comprises two rooks, two knights, two bishops and a queen disposed on the outside rows of the game board. Each player set further comprises seven pawns, disposed on the squares immediately in front of the seven principal pieces. Each team set of playing pieces further includes a warder, for common play by either team member. The warder is initially disposed on the square in advance of the king and may be moved to any of the squares within a designated "castle area". The warder may be captured only by a knight or pawn. Each team member is limited to moving the pieces of his assigned player set, plus his team's king and warder. Excepting the provisions relating to the warder, the movement of playing pieces and their capture may be the same as in the well recognized rules of the game of chess.

9 Claims, 1 Drawing Sheet

PLAYER A SET
CASTLE AREA
PLAYER B SET
TEAM 1 SET
10
TEAM 2 SET
PLAYER C SET
CASTLE AREA
PLAYER D SET

P

W

CHESS GAMES

The present invention relates to board games and more particularly to improvements in chess games.

The game of chess has existed, virtually unchanged, for centuries. This recognizes the fascination of its inherent challenge to players in matching wits and strategies.

Even so, there are always those who seek an even greater challenge.

To this end there have been prior proposals for participation of three or four players instead of the usual two players. This is exemplified in U.S. Pat. No. 4,093,237—Weiss, where the conventional number of chess pieces for each of four players are initially positioned, respectively, in the corners of an enlarged game board.

Four player participation is also taught in U.S. Pat. No. 4,021,043—Lucero, where the players form two-man teams. A conventional 16 piece, per side, chess set and 64 square board are employed. The 16 pieces are then split into a "king's side" and a "queen's side" and color coded for play, respectively by the two members of the team.

Another attempt to improve the challenge of the conventional chess game is found in U.S. Pat. No. 1,141,909—d'Autremont. There the game board is widened to include an additional column of squares to provide room for the inclusion, on each side, of an additional pawn and a further playing piece, having the combined moves of a queen and knight. d'Autremont also proposes that each player make ten preliminary moves to preposition the playing pieces prior to alternate moves in conventional play, all to the end that the game might be played more expeditiously.

A somewhat similar proposal is found in U.S. Pat. No. 3,761,093—Migliore, where one or more pieces of a 16 piece, per side, chess set have the characteristic of a wild card. That is the squares of the game board are marked to indicate the move available (as a queen, or a knight, etc.) to a game piece resting on that square.

None of these proposals has had any measure of commercial or popular acceptance.

The motivating factor for the present invention is a recognition that the two-man team approach has had a great potential both for increasing the challenge of chess and increasing the number of participants. Additionally this approach also aids in increasing the skill levels of the participants.

Accordingly, the object of the present invention is to provide an improved chess game particularly adapted for play by two-man teams.

Another object of the present invention is to provide an improved game board and set of playing pieces fulfilling these ends.

These ends are attained by an improved chess game for play by opposing two-man teams. The chess game comprises a game board having a plurality of squares disposed in aligned columns and rows, and a set of playing pieces.

The set of playing pieces comprises one set of pieces for first team and a another set for a second team, with each set consisting of corresponding pieces.

The set of pieces for each team comprises a single king and two sets of principal playing pieces, one for each team member, each player set includes a rook, a knight, a bishop and a queen, plus a pawn for each of the principal pieces, Each player set may further include a second rook, a second knight and a second bishop, and pawns therefor.

The playing pieces of each player set are uniquely identifiable. This end may be attained by color coding, or by using different materials or distinctive designs for each of the four player sets.

The game board has a row of squares, on each side, on which the king and the principal playing pieces may be separately positioned at the beginning of a game, with the king on a central square and the principal pieces of the player sets respectively disposed towards opposite ends of the board and the pawns disposed on the row of squares immediately ahead of the squares occupied by the principal pieces.

In play, the king is a common playing piece for play by either member of a team, as the team members cooperate in its defense and attack on the opponents king, through play of the pieces of their respective player sets.

Additionally each team set of playing pieces may include a warder, for play by either member of the team. The warder may be initially disposed on the square immediately ahead of the king. The warder may be limited to movement within a limited number of squares centrally of its initial position, yet permitted to be moved to any of the designated squares on a given turn. The value of the warder may be enhanced by limiting its capture to designated pieces, preferably a knight or pawn.

The above and other related objects and features of the invention will be apparent from a reading of the following description of a preferred embodiment, with reference to the accompany drawing, and the novelty thereof pointed out in the appended claims.

Figures 1, 2, 3:
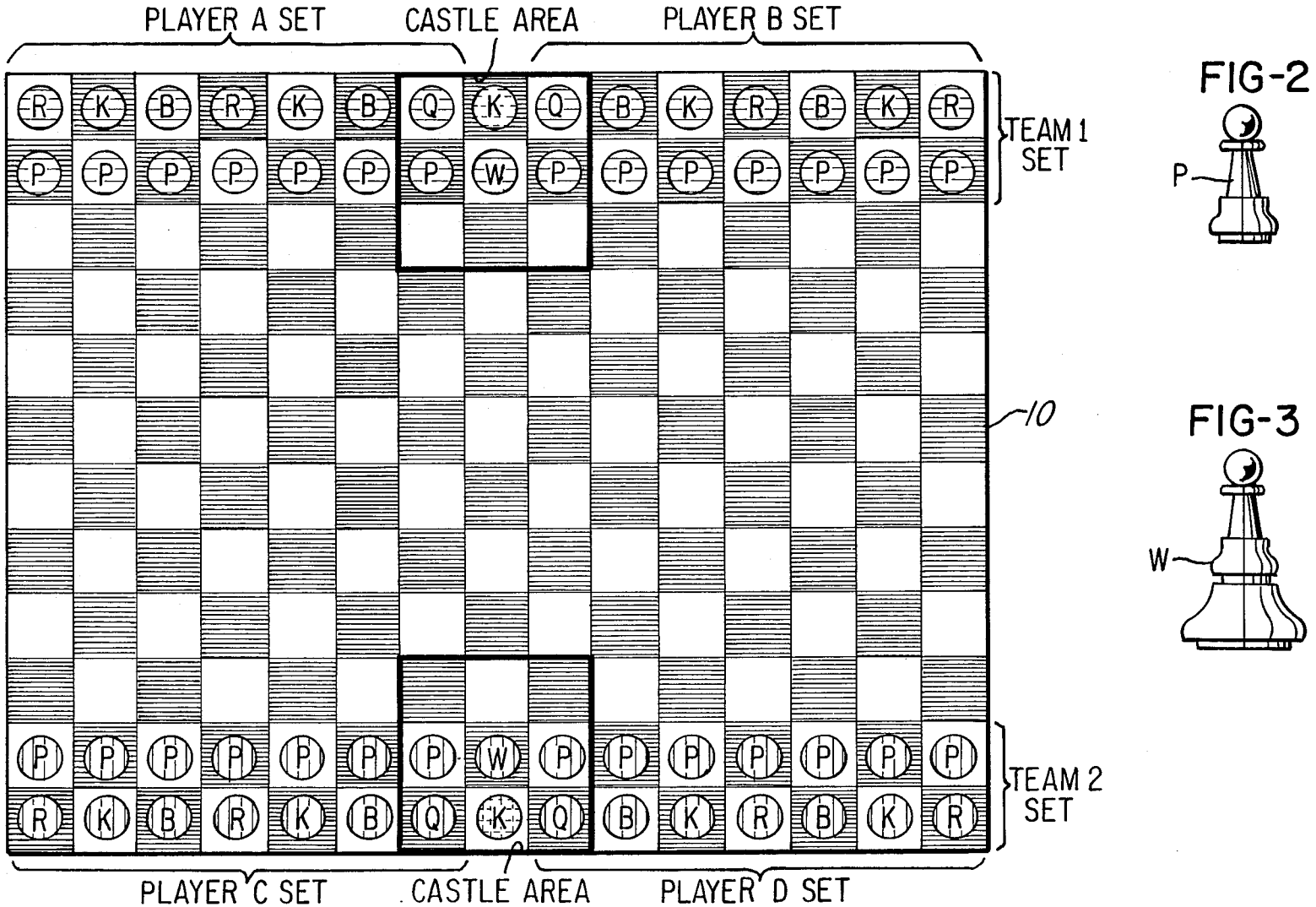
FIG. 1 illustrate a game set embodying the present invention.
FIG. 2 is an elevation of a playing piece in the form of a pawn.
FIG. 3 is an elevation of a unique playing pieces herein designated a warder.

The present, improved chess game is devised for play by two opposing teams, each consisting of two players, herein designated as players A and B for Team 1 and players C and D for the Team 2.

The present game set comprises a game board which is fifteen squares wide and, preferably, twelve squares deep. These squares may be distinguished by alternating colors, indicated by parallel lines in the drawing (these lines are not section hatching).

Each team is provided with a set of thirty playing pieces. The set for Team 1 would comprise fourteen pieces to be played exclusively by player A and fourteen pieces to be played by player B. The remaining two pieces are subject to play by either member, player A or B, of the team. The playing pieces of the Team 2 set correspond in all respects to those of the Team 1 set.

The fourteen playing pieces designated for play by a team member, or a player set of playing pieces, comprise seven pawns P and seven principal pieces, namely two rooks R, two knights K, two bishops B and one queen Q.

The two pieces for common play comprise a king K and a unique piece designated a warder W, the function of which is more fully set forth below.

The pieces of each Team set are separately identifiable. Also the pieces of each player set are separately identifiable. Such end may be attained by forming the Team 1 set as white playing pieces. Player A set would then have blue bases, indicated by the pawn P in FIG. 2. Player B set would have red bases. Team 2 set could then comprise black pieces and Player C set provided with yellow bases and Player D set provided with green bases.

It will be appreciated the thirty piece set provides each player of a team with all of the playing pieces which he has in normal play, excepting the king and king's pawn. The essence of the game is to protect the king. The single king, of each side, becomes the common piece of both team members, with the responsibility of protecting it from capture by the opposing team. The warder uniquely assists in the defense of this piece and is subject to the common control of the two team members.

At the start of a game, the playing pieces are disposed on the board 10 as indicated in the drawing. The disposition of pieces generally follows conventional practice. Thus the principal pieces, for each team, are place on the outside row of square on each side of the board and, respectively, occupying the squares at opposite ends of the board. The seven pawns then occupy the squares immediately in front of the principal pieces.

The initial placement of the principal pieces approximates their convention disposition. That is the rooks occupy the corner squares, with the knight and bishop being in that sequence inwardly from the corners. The same seqence is repeated for the second set of principal pieces, with each players queen being disposed next to the single king. The warder occupies the square immediately in front of the central square which it occupies.

The preferred method of play for the present game will now be described. Play can be initiated by designating the player to make the first move through any method of random chance.

The moves permitted to the several playing pieces are, generally, the same as in conventional chess play, as is well known to those familiar with the game. Likewise the rules for capture of pieces is the same, with one exception, noted below, The "castling" move is also the same as in a conventional game. It can be employed once by either or both players of a team, employing either of his own rooks.

The warder piece W functions as a "super" pawn for protection of its king. Its movement is limited to a central, nine square area designated as a "Castle Area" (not to be confused with the "castling" move). On a given move the warder can be placed on any square in the Castle Area for protection of the king, or any other piece.

While limited in its area of movement, the importance of the warder may be enhanced by requiring that its capture be limited to an opponent's pawns or knights. It may also be provided that the warder may not be returned to the game, as the other pieces may be, upon a pawn's reaching the opposite side of the board.

The sequence of moves alternates between the two teams and between members of the teams. A preferred sequence being player A, player D, player B, player C, player A, etc.

The object of the game remains the same, namely to checkmate the opponents king. Similarly a game can end in a draw where neither team has the ability to checkmate the opponent's king.

It will also be apparent that, in the course of play, all of the playing pieces of one team member can be captured by the opponents. When this occurs, that team player is eliminated. That is, even though he has the right to move the king or warder, that right is dependent on his still having at least one of his own pieces in play.

After the elimination of a player, play continues until the king of one team or the other is stalemated, or the game otherwise terminated. The sequence of play is alternated between the teams and alternated between the two members of the team which remains intact. When both teams are reduced to one member, play simply alternates between those two, surviving players.

It will also be appreciated that the game may be played by two players, who would alternately move the pieces of the two sets ordinarily reserved for exclusive movement by the individual team members.

There are several unique features found in the present chess game. Thus, the increased number of pieces and board squares increases the possibilities and permutations of strategic moves of effecting the objective of checkmating the opponent's king. That this end is sought by different players on a team enhances the unpredictability of an effective defense because the style and strategy of the team members will differ.

The introduction of a unique playing piece for defense of the common king brings new strategies into play. However these strategies are consistent with the traditional strategies long recognized in the playing of chess.

Similarly, the need for cooperation between team members in the defense of their king, as well as attack on the opponent's king, presents a challenge not found in individual play.

Another benefit is found in the training of novice players. When paired with a more experienced player, they may confer and the novice player can more quickly comprehend the reasoning behind a given strategy. In other levels of play, it may be preferred to prohibit consultation between team members, presenting a greater challenge to their efforts in coordinating strategy.

In summary, the present invention provides a chess game which has an increased level of challenge and enhances the skill levels of those who participate in its play. Most importantly, it preserves the traditional strategies of chess so that the skills developed in its play, when a player later participates in conventional chess games.

It is to be appreciated that variations from the specific description herein will occur to those skilled in the art, within the spirit and scope of the present inventive concepts, which are set forth in the following claims.

Having thus described the invention, what is claimed as novel and desired to be secured by Letters Patent of the United States is:

1. An improved chess game, for play by opposing two-man teams, said game comprising a game board having a plurality of squares disposed in aligned columns and rows, and a set of playing pieces, said set of playing pieces comprising one set of pieces for a first team and another set for a second team, with each set consisting of corresponding pieces, the set of pieces for a team comprising a single king and two sets of principal playing pieces, one for each team member, each player set including a rook, a knight, a bishop and a queen, plus a pawn for each of said principal pieces, each of said team sets of playing pieces having first identification means separately identifying the two team sets, each of said team sets of playing pieces further having second identification means separately identifying the player sets of each team set, wherein the king piece of each team having only said first identification means separately identifying it from the pieces of the player sets, said game board having a row of squares, on each side, on which the king and the principal playing pieces may be separately positioned at the beginning of a game, with the king on a central square and the principal pieces of the player sets respectively disposed towards opposite ends of the board and the pawns disposed on the row of squares immediately ahead of the squares occupied by the principal pieces.

2. An improved chess game as in claim 1 wherein each team set further includes an additional, warder playing piece, initially disposed on the square immediately ahead of the king.

3. An improved chess game as in claim 2 wherein the game board has two designated areas of squares to which movement of the warder playing pieces are, respectively, limited, each designated area of squares encompassing the initial position of the respective warder and its associated king and extending laterally thereof and toward the center of the board.

4. An improved chess game as in claim 3 wherein each player set further includes a second rook, a second knight and a second bishop.

5. An improved chess game as in claim 4 wherein the first identification means comprises different color coding of the playing pieces of each team set to provide for their separate identification, the playing pieces have base portions, and the second identification means comprises different color coding of the base portions of each player set to provide for their separate identification.

6. The method of playing a chess game by opposing, two-man teams, wherein the game set comprises a game board having a plurality of squares disposed in aligned columns and rows, and a set of playing pieces, said set of playing pieces comprising one set of pieces for a first team and another set for a second team, with each set consisting of corresponding pieces, the set of pieces for a team comprising a single king and two sets of principal playing pieces, one for each team member, each player set including a rook, a knight, a bishop and a queen, plus a pawn for each of said principal pieces, the two team sets of playing pieces being separately identifiable, and the player sets of each team set also being separately identifiable, comprising the steps of initially positioning each team set with the king on the central square of the outside row of squares on opposite sides of the board and each player set respectively disposed on towards opposite ends of the boards, and the pawns on the squares immediately ahead of the principal pieces, moving the playing pieces pursuant to conventional movements and rules of capture, with the sequence of moving playing pieces alternating between the two teams and, so long as both team members of a team have an uncaptured playing piece, alternating between the team member when it is their team's turn to move a playing piece, and further characterized in that each team member is limited to moving pieces of his players set plus his team's king.

7. The method of playing a chess game as in claim 6, wherein each team set of playing pieces comprises an additional playing piece, and the game board has a designated area of squares on each side of the board and further comprising the steps of initially disposing each additional playing piece on the square immediately in advance of the king, each designated area including the square on which the additional playing piece is initially positioned, and either team member may move the additional playing piece of his team's set to any square within said designated area.

8. A method as in claim 7 wherein each player is limited to conventional movements of a knight or pawn of his players set to effect capture of the additional playing pieces of the opposite team's set.

9. A method as in claim 8 wherein each player set includes a second rook, a second knight and a second bishop and three additional pawns, and the step of initially positioning each player set includes positioning the queen next to the king, and positioning the principal playing pieces, from the queen, in the sequence of bishop, knight, rook, bishop, knight, rook to the square at the end of the board, and each team makes one move of a playing piece on the alternating turns of the team and the players of a team alternate in making moves for their team.

* * * * *